US006938612B2

(12) United States Patent
Porter

(10) Patent No.: US 6,938,612 B2
(45) Date of Patent: Sep. 6, 2005

(54) AUXILIARY FUEL DISPENSING SYSTEM

(75) Inventor: Donald Kevin Porter, Olivet, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/645,973

(22) Filed: Aug. 21, 2003

(65) Prior Publication Data

US 2005/0039727 A1 Feb. 24, 2005

(51) Int. Cl.[7] ..... F02M 37/04

(52) U.S. Cl. ..... 123/509; 123/198 D; 137/142; 137/565.29; 417/360

(58) Field of Search ..... 123/509, 514, 123/516, 198 D, 495; 137/142, 151, 152, 565.29, 565.37, 565.16, 565.33; 417/360

(56) References Cited

U.S. PATENT DOCUMENTS

| | | | | | |
|---|---|---|---|---|---|
| 2,932,946 | A | * | 4/1960 | Smedley et al. | 60/39.281 |
| 3,677,284 | A | | 7/1972 | Mendez | 137/351 |
| 4,064,901 | A | * | 12/1977 | Bailey | 137/351 |
| 4,726,335 | A | * | 2/1988 | Brauninger | 123/198 D |
| 4,860,714 | A | * | 8/1989 | Bucci | 123/514 |
| 5,092,294 | A | | 3/1992 | Jackson | 123/198 |
| 5,234,016 | A | * | 8/1993 | Winn | 137/142 |
| 5,529,462 | A | * | 6/1996 | Hawes | 417/360 |
| 5,718,260 | A | | 2/1998 | Leonardi | 137/355.16 |
| 6,056,028 | A | | 5/2000 | Crawford | 141/382 |
| 6,167,903 | B1 | | 1/2001 | Newman | 137/351 |
| 6,276,342 | B1 | * | 8/2001 | Sinz et al. | 123/514 |
| 6,371,159 | B1 | | 4/2002 | Timberlake | 137/572 |
| 6,390,871 | B1 | * | 5/2002 | Wickman et al. | 440/88 R |
| 6,527,603 | B1 | * | 3/2003 | Wickman et al. | 123/509 |
| 6,718,953 | B1 | * | 4/2004 | Torgerud | 123/516 |

* cited by examiner

*Primary Examiner*—Carl S. Miller
(74) *Attorney, Agent, or Firm*—Laura C. Hargitt

(57) ABSTRACT

An auxiliary fuel dispensing system includes an auxiliary fuel pump disposed in a vehicle fuel tank. An auxiliary dispensing tube is connected at one end to the auxiliary fuel pump and at another end to an auxiliary dispensing location on the vehicle. One end of a fuel delivery hose is releasably connected to the end of the tube at the auxiliary dispensing location. Another end of the hose has a dispensing nozzle attached thereto. A means for selectively activating the pump is operable to pump fuel from the fuel tank, through the tube and the hose, and out the nozzle.

3 Claims, 3 Drawing Sheets

AUXILIARY FUEL DISPENSING SYSTEM

BACKGROUND OF THE INVENTION

The present invention relates in general to automotive fuel systems and, in particular, to an auxiliary fuel dispensing system.

Automotive fuel systems are well known. A typical automotive fuel system includes a fuel tank having a fuel pump for supplying fuel from the fuel tank to the automobile's engine. The fuel pump is typically disposed within the fuel tank.

When fuel is transported in a separate container in a vehicle, some vehicles, such as station wagons and sport utility vehicles disadvantageously do not have a trunk or similar space for storing the fuel container during transport. Over a long period of time, the fuel vapors from the fuel container can become irritating to the occupants of vehicle. In addition, it is tedious to transport small containers of gasoline multiple times because of quantity limitations and it is cumbersome to transport large containers of gasoline because of size and weight concerns.

In addition, fuel containers have limited capacity and, when empty, must be replenished, causing time delays when utilizing lawn equipment, boats, and the like, which often do not have large fuel tanks and need to be refueled more frequently and are not easy to get to a filling station.

It is desirable, therefore, to provide an apparatus for removing fuel from the fuel tank of a vehicle in order to reduce the need for carrying filled fuel containers in the vehicle, and to provide a means for filling fuel containers or auxiliary equipment without the need for a separate fuel container.

SUMMARY OF THE INVENTION

The present invention concerns an apparatus for dispensing fuel from the fuel tank of a vehicle. The vehicle fuel tank has a primary fuel pump disposed therein and a fuel filler neck attached thereto. The apparatus includes an auxiliary fuel pump adapted to be disposed in the fuel tank of the vehicle, and an auxiliary dispensing tube having one end connected to an outlet of the pump and an opposite end connected to an auxiliary dispensing location on the exterior of the vehicle. The apparatus also includes a fuel delivery hose having one end releasably attached to the opposite end of the tube and an opposite end with a dispensing nozzle attached thereto and a means for selectively activating the pump to pump fuel from the tank, through the tube and the hose, and out the nozzle.

The apparatus in accordance with the present invention advantageously provides a means for removing fuel from the fuel tank of a vehicle. The apparatus in accordance with the present invention will also advantageously reduce the need for carrying filled fuel containers in the vehicle, and will provide a means for filling fuel containers and auxiliary equipment without the need for a separate fuel container.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
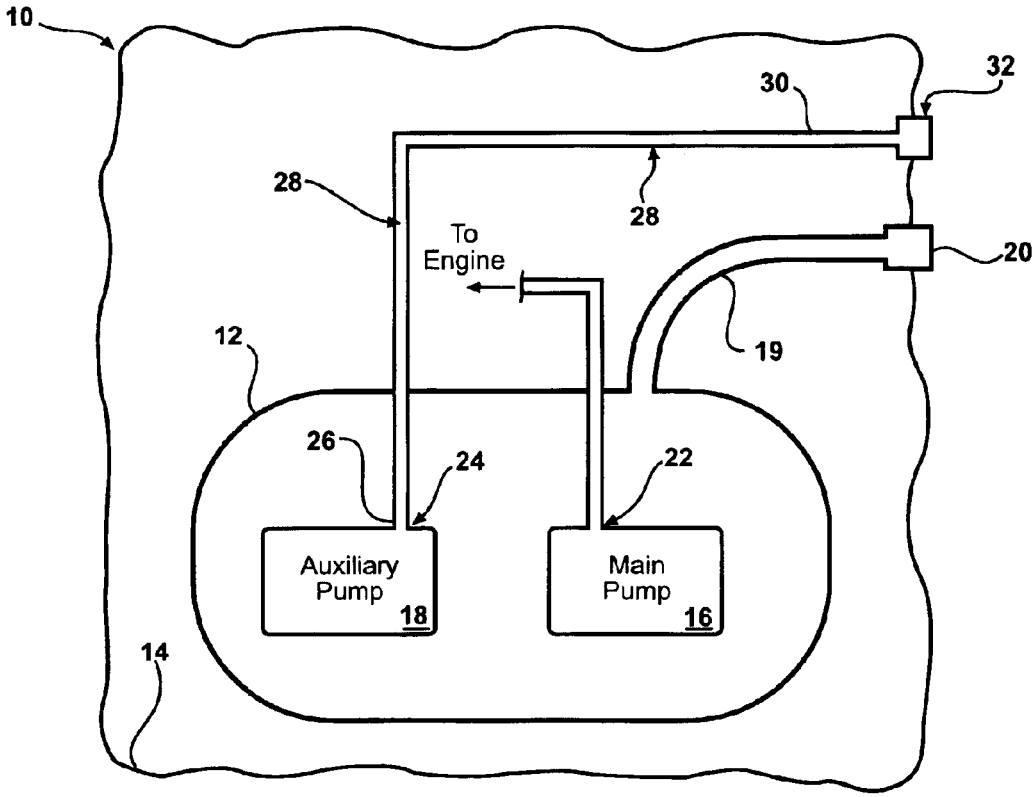
FIG. 1 is a schematic view of an apparatus for dispensing fuel in accordance with the present invention.
Figure 2:
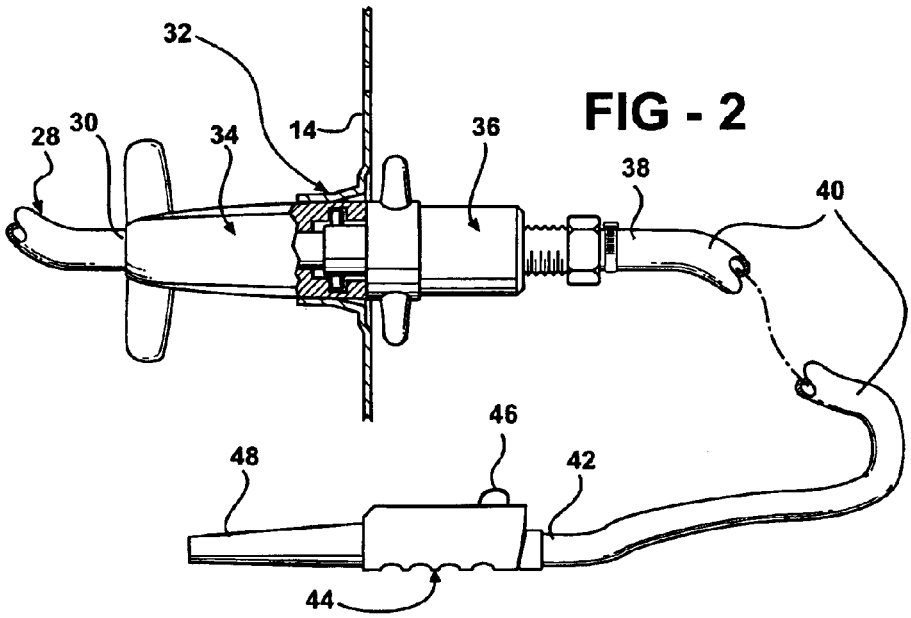
FIG. 2 is a schematic view of a dispensing hose used with the apparatus shown in FIG. 1 in accordance with the present invention.

Referring now to FIGS. 1 and 2, an auxiliary fuel dispensing apparatus is indicated generally at 10. The apparatus 10 includes a fuel tank 12 disposed in a vehicle, indicated schematically at 14. A main fuel pump 16 and an auxiliary fuel pump 18 are disposed in the fuel tank 12. A fuel filler neck 19 extends to the fuel tank 12 from a fuel pocket 20 formed in the exterior of the vehicle 14. An outlet 22 of the main fuel pump 16 is in fluid communication with an engine fuel system (not shown) of the vehicle 14.

An outlet 24 of the auxiliary fuel pump 18 is connected to an end 26 of an auxiliary dispensing tube 28. The tube 28 is preferably formed of steel or similar strength material. Another end 30 of the auxiliary dispensing tube 28 is connected to an auxiliary dispensing outlet 32 located on the exterior surface of the vehicle 14. The auxiliary dispensing outlet 32 may be located at any point on the vehicle 14 including, but not limited to, a separate auxiliary fuel pocket adjacent a trailer hitch, a separate auxiliary fuel pocket adjacent the main fuel pocket 20, or any other location where it is advantageous or convenient to locate a fuel dispensing location on an exterior surface of the vehicle 14.

Referring now to FIG. 2, the end 30 of the dispensing tube 28 that is disposed in the auxiliary dispensing outlet 32 includes a fitting 34 that is adapted to receive a corresponding fitting 36 on an end 38 of a fuel delivery hose 40. On an end 42 opposite the end 38, the fuel delivery hose 40 includes a dispensing nozzle assembly 44 attached thereto. The nozzle assembly 44 includes a manually operated nozzle switch 46 and a dispensing nozzle 48 for dispensing fuel therefrom. Preferably, the fittings 34 and 36 are commercially available cam lock-type fuel fittings, such as, but not limited to, the Mercury outboard fuel fittings, SeaSense part numbers 50052312 and 50052322, available from Unified Marine, Inc.

Figure 3:
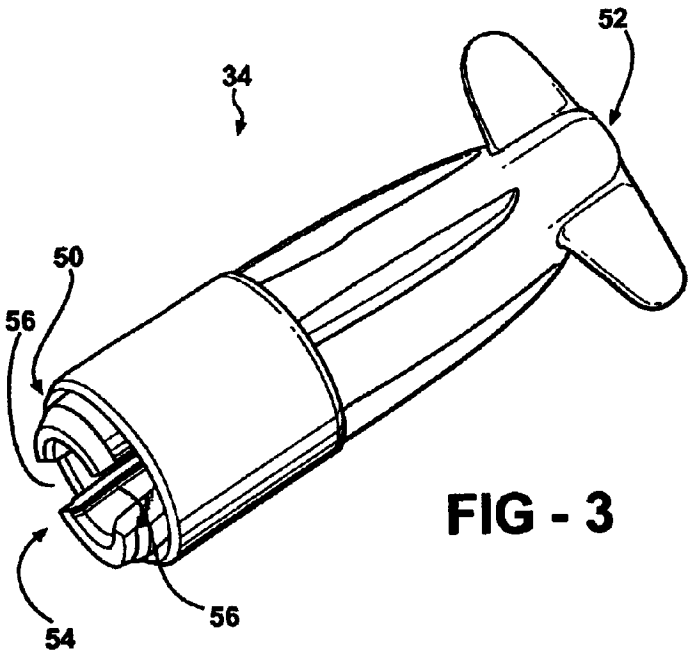
FIG. 3 is a perspective view of one of the fittings shown in FIG. 2.

There is shown in FIG. 3, a perspective view of an embodiment of the fitting 34. The fitting 34 includes an open first end 50 and a second end 52. The first end 50 includes a mounting flange 54 having opposed openings 56 therein. The mounting flange 54 has a diameter smaller than the first end 50 of the fitting 34. The second end 52 is adapted to be attached to the end 30 of the auxiliary dispensing tube 28 at the auxiliary dispensing outlet 32. The first end 50 is adapted to be releasably attached to the fitting 36 on the end 38 of the fuel delivery hose 40, discussed in more detail below. The fitting 34 preferably includes an internal spring-loaded check valve (not shown) disposed therein, discussed in more detail below. The spring biases the mounting flange 54 to the position shown.

Figure 4:
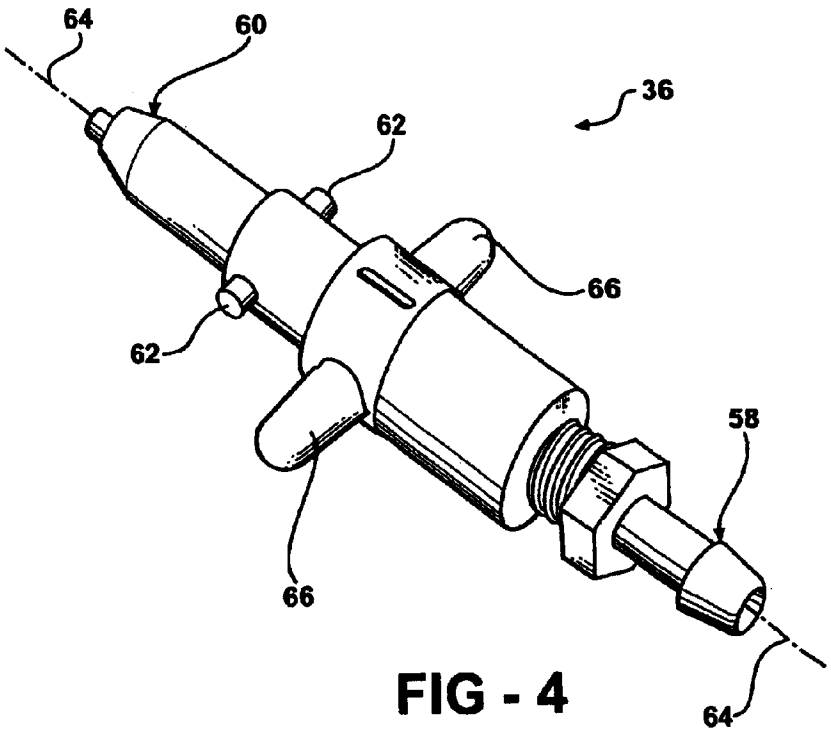
FIG. 4 is a perspective view of another one of the fittings shown in FIG. 2.

There is shown in FIG. 4, a perspective view of an embodiment of the fitting 36. The fitting 36 includes a first end 58 and a second end 60. The first end 58 is adapted to be attached to the end 38 of the fuel delivery hose 40. The second end 60 is adapted to be releasably attached to the first end 50 of the fitting 36. A pair of opposed tabs 62 extend outwardly from a body portion of the fitting 36 intermediate the first end 58 and the second end 60.

When the fittings 34 and 36 are to be engaged, the tabs 62 are aligned with the openings 56 and the second end 60 is inserted into the open first end 50 of the fitting 34 far enough such that the tabs 62 extend into the openings 56. The tabs 62 engage with a surface (not shown) on an internal surface of the mounting flange 54 and are guided by grooves (not shown) on an inner surface of the first end 50 of the fitting 34. The grooves are preferably in the form of conventional L-shaped slots. As the fitting 36 is inserted, the check valve spring is compressed by the mounting flange 54, which opens the internal check valve of the fitting 34 and the tabs 62 travel in the grooves in the inner surface of the fitting 34. The fitting 36 is then rotated about a longitudinal axis 64 thereof for a predetermined distance such that the tabs 62 engage with the respective L-shaped slots in order to ensure the engagement of the fittings 34 and 36. The fitting 36 is held in place by the spring pressure of the check valve spring acting against the mounting flange 54 and the tabs 62. Alternatively, similar retaining means is utilized for ensuring a proper connection between the fittings 34 and 36. Preferably, the fitting 34 functions as a female cam lock on the end 30 of the tube 28 and the fitting 36 a cooperating male cam lock on the end 38 of the hose 40. A pair of projections 66 on the body portion of the fitting 36 intermediate the tabs 62 and the first end 58 assist in providing a handhold for rotating the fitting 36 during engagement of the fittings 34 and 36.

Figure 5:
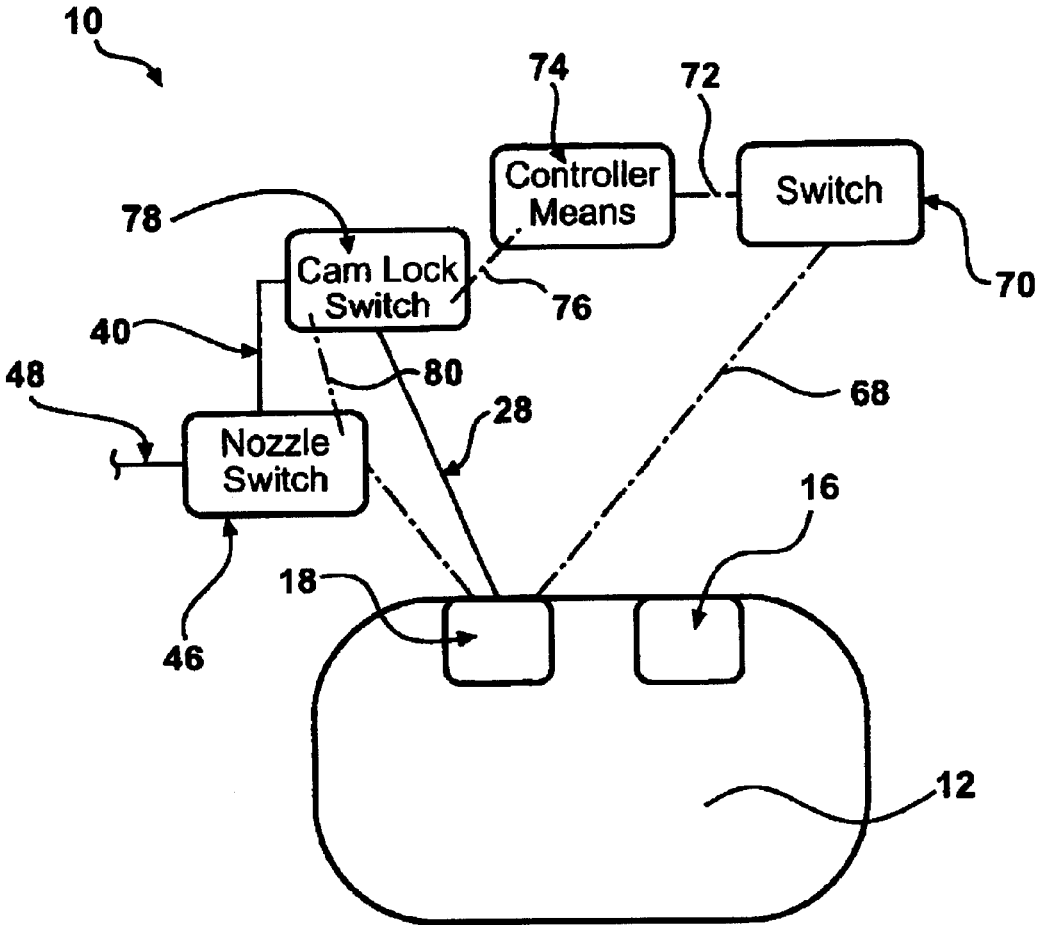
FIG. 5 is a schematic view of electrical connections and interlocks of the apparatus shown in FIGS. 1 and 2.

Referring now to FIG. 5, a schematic view of electrical connections and interlocks in accordance with the present invention is shown. The apparatus 10 includes an electrical connection 68 from the auxiliary pump 18 to a manually operated control switch 70 that is preferably located in the vehicle interior, such as in the glove box. An electrical connection 72 is provided between the switch 70 and a controller means 74, such as the engine computer or the like, which determines whether certain conditions exist, discussed in more detail below, where fuel may be dispensed from the fuel tank 12 utilizing the apparatus 10. An electrical connection 76 is provided between the controller means 74 and a cam lock switch 78 that is preferably a part of the auxiliary dispensing outlet 32 and is activated when the fittings 34 and 36 are engaged and the check valve of the fitting 34 is open. The cam lock switch 78 is electrically connected by a connection 80 to the nozzle switch 46 for dispensing fuel (shown in FIG. 2) from the fuel tank 12 through the auxiliary dispensing tube 28, through the fuel delivery hose 40, and out the dispensing nozzle 48.

In operation, therefore, the auxiliary pump 18 may not be energized until each of the following interlock conditions are met: the switch 70 in the vehicle interior must be actuated; the controller means 74 utilizes a logic circuit (not shown) to determine if certain conditions, such as the vehicle engine being off, the vehicle transmission (not shown) in park, or similar type conditions exist where fuel may be dispensed from the fuel tank 12 utilizing the apparatus 10; the cam lock switch 78 must be engaged properly when the fittings 34 and 36 are engaged; and the nozzle switch 46 on the nozzle assembly 44 must be actuated. Not until each of the interlock conditions outlined above are in place will the nozzle switch 46 be able to activate the auxiliary fuel pump 18 and dispense fuel through the auxiliary dispensing tube 28, the fuel delivery hose 40, and out the dispensing nozzle 48.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An auxiliary fuel dispensing apparatus for dispensing fuel from a vehicle fuel tank, comprising:

an auxiliary fuel pump adapted to be disposed in a fuel tank of a vehicle;

an auxiliary dispensing tube having one end connected to an outlet of said pump and an opposite end adapted to be mounted to an auxiliary dispensing location on the exterior of the vehicle;

a fuel delivery hose having one end releasably attached to said opposite end of said tube and an opposite end with a dispensing nozzle attached thereto;

a locking means for releasably attaching said one end of said hose to said opposite end of said tube; and means for selectively activating said pump when said pump is disposed in the tank to pump fuel from the tank, through said tube and said hose and out said nozzle;

wherein said means for selectively activating includes a lock switch actuated by said locking means for enabling said means for selectively activating when said hose is securely attached to said tube by said locking means.

2. An auxiliary fuel dispensing apparatus for dispensing fuel from a vehicle fuel tank, comprising:

an auxiliary fuel pump adapted to be disposed in a fuel tank of a vehicle;

an auxiliary dispensing tube having one end connected to an outlet of said pump and an opposite end adapted to be mounted to an auxiliary dispensing location on the exterior of the vehicle;

a fuel delivery hose having one end releasably attached to said opposite end of said tube and an opposite end with a dispensing nozzle attached thereto; and means for selectively activating said pump when said pump is disposed in the tank to pump fuel from the tank, through said tube and said hose, and out said nozzle;

wherein said means for selectively activating includes a logic circuit for enabling said means for selectively activating when at least one of an engine of the vehicle is turned off and a transmission of the vehicle is in a park mode.

3. An auxiliary fuel dispensing system for dispensing fuel from a fuel tank of a vehicle, comprising:

a fuel tank having a primary fuel pump disposed therein and being attached to a vehicle;

an auxiliary fuel pump disposed in said tank;

an auxiliary dispensing tube having one end connected to said auxiliary fuel pump and an opposite end at an auxiliary dispensing location on the vehicle;

a fuel delivery hose having one end releasably attached to said opposite end of said tube and an opposite end with a dispensing nozzle attached thereto; and means for selectively activating said auxiliary fuel pump to pump fuel from said fuel tank through said tube and said hose, and out said dispensing nozzle;

wherein said means for selectively activating includes a logic circuit for enabling said means for selectively activating when at least one of an engine of the vehicle is turned off and a transmission of the vehicle is in a park mode.

* * * * *